US009677573B2

(12) United States Patent
Jaffrey

(10) Patent No.: US 9,677,573 B2
(45) Date of Patent: Jun. 13, 2017

(54) MEASUREMENT SYSTEM

(71) Applicant: Cameron International Corporation, Houston, TX (US)

(72) Inventor: Andrew Jaffrey, Oldmeldrum (GB)

(73) Assignee: Cameron International Corporation, Houston, TX (US)

( * ) Notice: Subject to any disclaimer, the term of this patent is extended or adjusted under 35 U.S.C. 154(b) by 369 days.

(21) Appl. No.: 14/181,185

(22) Filed: Feb. 14, 2014

(65) Prior Publication Data

US 2015/0233398 A1 Aug. 20, 2015

(51) Int. Cl.

| | |
|---|---|
| ***F15B 15/28*** | (2006.01) |
| ***F15B 1/08*** | (2006.01) |
| ***E21B 33/06*** | (2006.01) |

(52) U.S. Cl.

CPC ..... *F15B 1/08* (2013.01); *E21B 33/06* (2013.01); *F15B 15/2815* (2013.01); *F15B 2201/205* (2013.01); *F15B 2201/31* (2013.01); *F15B 2201/3153* (2013.01); *F15B 2201/515* (2013.01)

(58) Field of Classification Search

CPC ..... F15B 1/08; F15B 1/2201; F15B 2201/31; F15B 2201/205; F15B 2201/3153; F15B 2201/515; F15B 2215/30; F15B 2215/305; F15B 15/2815; E21B 33/06

See application file for complete search history.

(56) References Cited

U.S. PATENT DOCUMENTS

| | | | | |
|---|---|---|---|---|
| 5,024,250 | A * | 6/1991 | Nakamura | F15B 1/08 138/104 |
| 6,450,048 | B1 | 9/2002 | Samuelson et al. | |
| 6,953,328 | B2 * | 10/2005 | Welch, Jr. | F04B 35/004 417/331 |
| 7,527,074 | B1 * | 5/2009 | Gray, Jr. | F15B 1/165 138/26 |
| 8,327,984 | B2 * | 12/2012 | Foister | F16F 9/535 188/267 |
| 2007/0157612 | A1 * | 7/2007 | He | F15B 1/02 60/413 |
| 2008/0196888 | A1 | 8/2008 | Judge et al. | |

(Continued)

OTHER PUBLICATIONS

International Search Report and Written Opinion dated May 14, 2015, issued in corresponding application No. PCT/US2015/015052, 12 pgs.

*Primary Examiner* — Logan Kraft
(74) *Attorney, Agent, or Firm* — Chamberlain Hrdlicka

(57) ABSTRACT

A system for determining the location of a piston within an accumulator is provided in which a short circuit is created between elements in the accumulator and the piston which is movable within the accumulator. As the piston moves along the longitudinal axis of the accumulator, the circuit's electrical characteristics (e.g., voltage, resistance, current) vary in accordance with the length of the circuit. Measurement of these electrical characteristics allows for precise determination of the piston location relative to the accumulator. In a commercial embodiment, the invention can be utilized to determine fluid volumes in an accumulator by monitoring the location of the piston. This invention overcomes prior art systems because, inter alia, it does not require electrical sensory equipment, enables remote monitoring, maintains system integrity and functions irrespective of container wall thickness.

18 Claims, 6 Drawing Sheets

(56) References Cited

U.S. PATENT DOCUMENTS

| | | | | |
|---|---|---|---|---|
| 2010/0307233 | A1 | 12/2010 | Glasson et al. | |
| 2011/0283882 | A1* | 11/2011 | Stanford | F15B 15/1428 92/169.1 |
| 2012/0000646 | A1 | 1/2012 | Liotta et al. | |
| 2012/0103629 | A1 | 5/2012 | Dietz | |
| 2013/0283917 | A1 | 10/2013 | Coonrod et al. | |
| 2014/0123746 | A1 | 5/2014 | Jaffrey et al. | |

* cited by examiner

MEASUREMENT SYSTEM

BACKGROUND

In most offshore drilling operations, a wellhead at the sea floor is positioned at the upper end of the subterranean wellbore lined with casing, a blowout preventer ("BOP") stack is mounted to the wellhead and a lower marine riser package ("LMRP") is mounted to the BOP stack. The upper end of the LMRP typically includes a flex joint coupled to the lower end of a drilling riser that extends upward to a drilling vessel at the sea surface. A drill string is hung from the drilling vessel through the drilling riser, the LMRP, the BOP stack and the wellhead into the wellbore.

During drilling operations, drilling fluid, or mud, is pumped from the sea surface down the drill string, and returns up the annulus around the drill string. In the event of a rapid invasion of formation fluid into the annulus, commonly known as a "kick," the BOP stack and/or LMRP may actuate to help seal the annulus and control the fluid pressure in the wellbore. In particular, the BOP stack and the LMRP include closure members, or cavities, designed to help seal the wellbore and prevent the release of high-pressure formation fluids from the wellbore. Thus, the BOP stack and LMRP function as pressure control devices.

For most subsea drilling operations, hydraulic fluid for operating the BOP stack and the LMRP is provided using a common control system physically located on the surface drilling vessel. However, the common control system may become inoperable, resulting in a loss of the ability to operate the BOP stack. As a backup, or even possibly a primary means of operation, hydraulic fluid accumulators are filled with hydraulic fluid under pressure. The amount and size of the accumulators depends on the anticipated operation specifications for the well equipment.

An example of an accumulator includes a piston accumulator, which includes a hydraulic fluid section and a gas section separated by a piston movable within the accumulator. The hydraulic fluid is placed into the fluid section of the accumulator and pressurized by injecting gas (typically inert gas, e.g., nitrogen) into the gas section. The fluid section is connected to a hydraulic circuit so that the hydraulic fluid may be used to operate the well equipment. As the fluid is discharged, the piston moves within the accumulator under pressure from the gas to maintain pressure on the remaining hydraulic fluid until full discharge.

The ability of the accumulator to operate a piece of equipment depends on the amount of hydraulic fluid in the accumulator and the pressure of the gas. Thus, there is a need to know the volume of the hydraulic fluid remaining in an accumulator so that control of the well equipment may be managed. Measuring the volume of hydraulic fluid in the accumulator over time can also help identify if there is a leak in the accumulator or hydraulic circuit or on the gas side of the piston.

Currently, the ability of an accumulator to power equipment is determined by measuring the pressure in the hydraulic circuit downstream of the accumulator. However, pressure is not an indicator of the overall capacity of an accumulator to operate equipment because the volume of hydraulic fluid remaining in the accumulator is not known. Also, accumulators are typically arranged in banks of multiple accumulators all connected to a common hydraulic circuit, therefore, the downstream pressure measurement is only an indication of the overall pressure in the bank, not per individual accumulator.

A possible way of determining the volume of hydraulic fluid remaining in the accumulator is to use a linear position sensor such as a cable-extension transducer or linear potentiometer that attaches inside the accumulator to measure the movement of the internal piston. However, these electrical components may fail and because the discharge of hydraulic fluid may be abrupt, the sensors may not be able to sample fast enough to obtain an accurate measurement.

Another method of determining the volume of hydraulic fluid is through the use of physical position indicators that extend from the accumulator. These indicators only offer visual feedback though and are insufficient for remote monitoring and pose a significant challenge to maintaining the integrity of the necessary mechanical seals under full operating pressures.

Through-the-wall sensors (e.g., Hall effect sensors) have also been considered. However, the thickness and specifications of an accumulator wall is such that these types of sensors are not always able to penetrate the material.

SUMMARY

In accordance with the invention, a system for determining the location of a movable element within a container is provided in which a circuit is created between elements in the container, the movable element, and a power source. As the movable element moves along the longitudinal axis of the container, the circuit's electrical characteristics (e.g., voltage, resistance, current) vary in proportion to the length of the circuit. Measurement of these electrical characteristics allows for precise determination of the movable element's location relative to the container. In commercial embodiments, the invention can be utilized to determine fluid volumes in accumulators used for controlling subsea equipment by monitoring the location of a piston within a hydraulic fluid accumulator. This invention overcomes prior art systems because, among other reasons, it enables remote monitoring, maintains system integrity, and functions irrespective of the container wall thickness.

This summary is provided to introduce a selection of concepts that are further described below in the detailed description. This summary is not intended to identify key or essential features of the claimed subject matter, nor is it intended to be used as an aid in limiting the scope of the claimed subject matter.

DRAWINGS

For a detailed description of the preferred embodiments of the invention, reference will now be made to the accompanying drawings in which.

DETAILED DESCRIPTION

Figure 1:
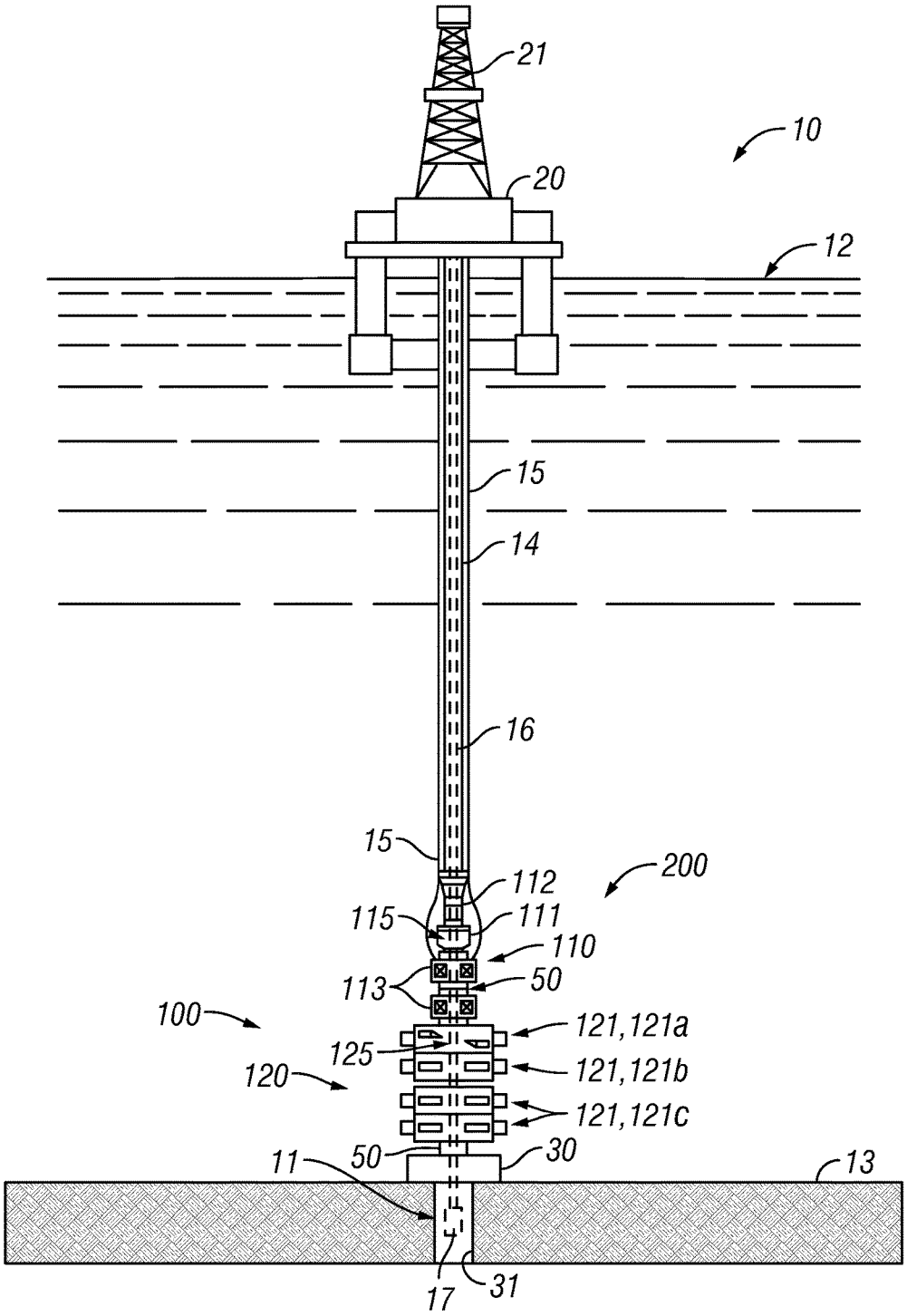
FIG. 1 shows a schematic view of an offshore system for drilling and/or producing a subterranean wellbore with an embodiment of a measurement system.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce the desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of an offshore system 10 for drilling and/or producing a wellbore 11 is shown. In this embodiment, the system 10 includes an offshore vessel or platform 20 at the sea surface 12 and a subsea BOP stack assembly 100 mounted to a wellhead 30 at the sea floor 13. The platform 20 is equipped with a derrick 21 that supports a hoist (not shown). A tubular drilling riser 14 extends from the platform 20 to the BOP stack assembly 100. The riser 14 returns drilling fluid or mud to the platform 20 during drilling operations. One or more hydraulic conduits 15 extend along the outside of the riser 14 from the platform 20 to the BOP stack assembly 100. The one or more hydraulic conduits 15 supply pressurized hydraulic fluid to the assembly 100. Casing 31 extends from the wellhead 30 into the subterranean wellbore 11.

Downhole operations are carried out by a tubular string 16 (e.g., drillstring, tubing string, coiled tubing, etc.) that is supported by the derrick 21 and extends from the platform 20 through the riser 14, through the BOP stack assembly 100 and into the wellbore 11. A downhole tool 17 is connected to the lower end of the tubular string 16. In general, the downhole tool 17 may comprise any suitable downhole tools for drilling, completing, evaluating and/or producing the wellbore 11 including, without limitation, drill bits, packers, cementing tools, casing or tubing running tools, testing equipment, perforating guns, and the like. During downhole operations, the string 16, and hence the tool 17 coupled thereto, may move axially, radially and/or rotationally relative to the riser 14 and the BOP stack assembly 100.

Figure 2:
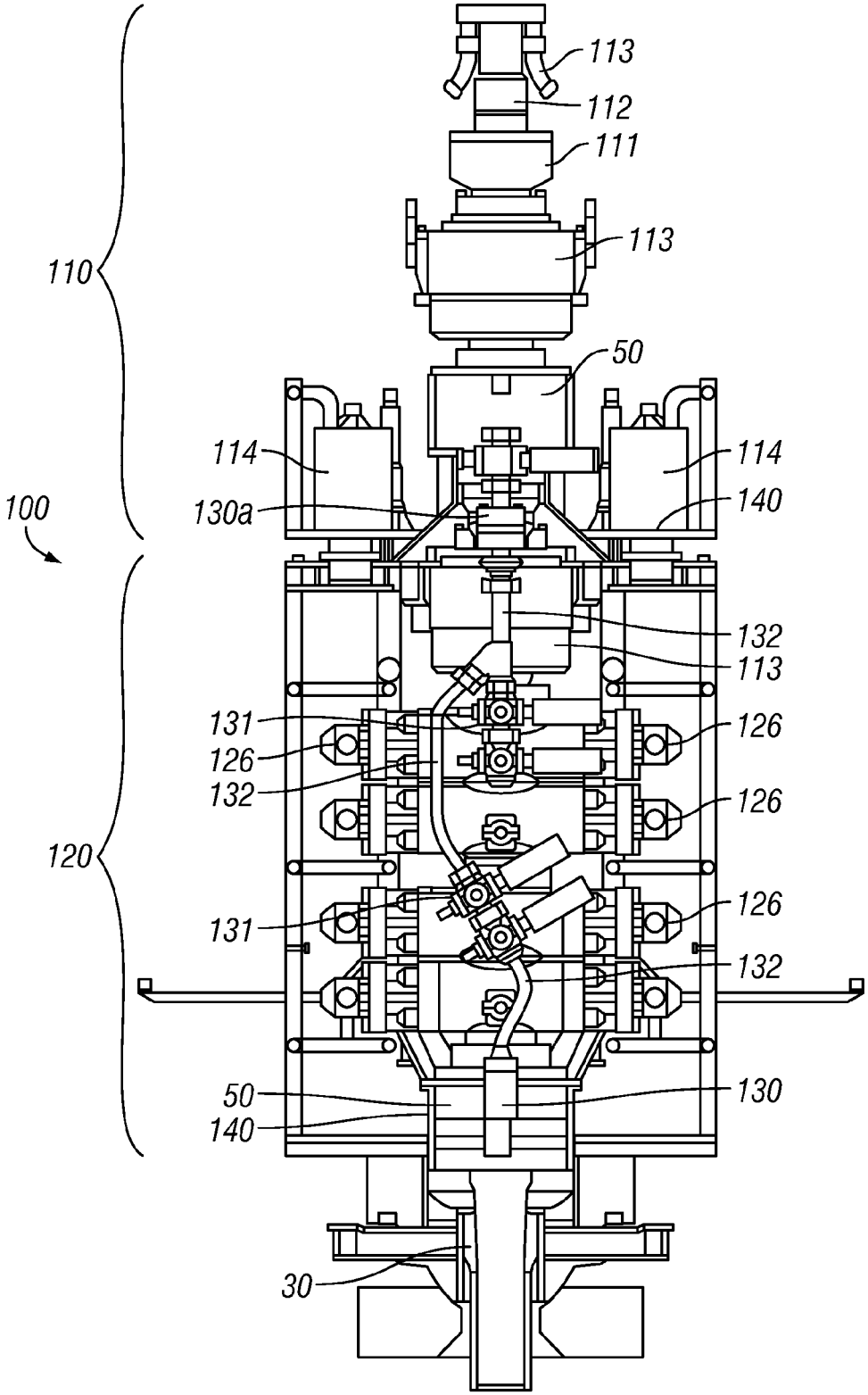
FIG. 2 shows an elevation view of the subsea BOP stack assembly and measurement system of FIG. 1.
Figure 3:
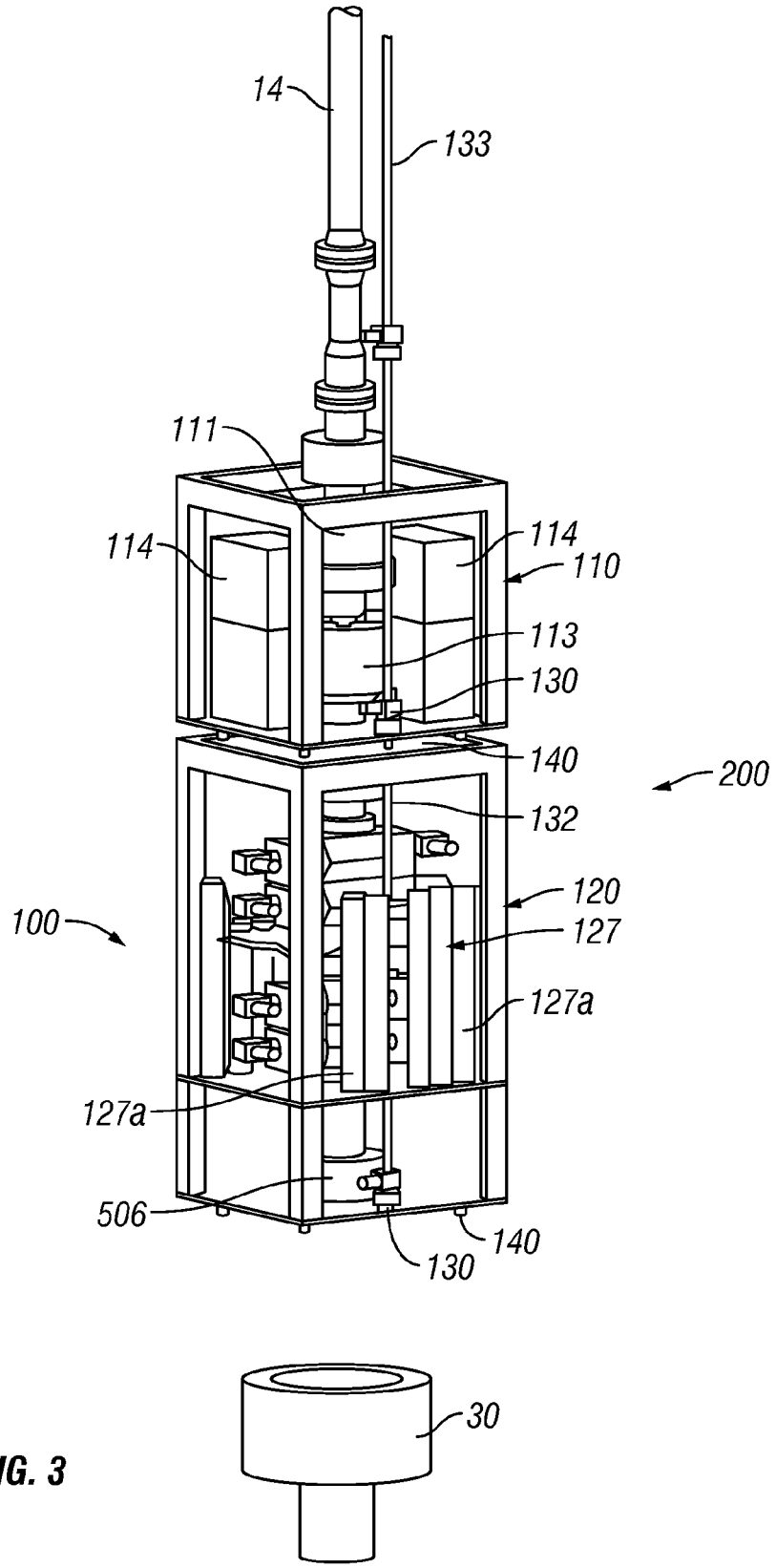
FIG. 3 shows a perspective view of the subsea BOP stack assembly and measurement system of FIGS. 1 and 2.

Referring now to FIGS. 1-3, the BOP stack assembly 100 is mounted to the wellhead 30 and is designed and configured to control and seal the wellbore 11, thereby containing the hydrocarbon fluids (i.e., liquids and gases) therein. In this embodiment, the BOP stack assembly 100 comprises a lower marine riser package (LMRP) 110 and a BOP or BOP stack 120.

The BOP stack 120 is releasably secured to the wellhead 30 as well as the LMRP 110 and the LMRP 110 is releasably secured to the BOP stack 120 and the riser 14. In this embodiment, the connections between the wellhead 30, the BOP stack 120 and the LMRP 110 include hydraulically actuated, mechanical wellhead-type connections 50. In general, the connections 50 may comprise any suitable releasable wellhead-type mechanical connection such as the DWHC or HC profile subsea wellhead system available from Cameron® International Corporation of Houston, Tex., or any other such wellhead profile available from several subsea wellhead manufacturers. Typically, such hydraulically actuated, mechanical wellhead-type connections (e.g., the connections 50) include an upward-facing male connector or "hub" that is received by and releasably engages a downward-facing mating female connector or receptacle **50*b*. In this embodiment, the connection between LMRP 110 and the riser 14 is a flange connection that is not remotely controlled, whereas the connections 50** may be remotely, hydraulically controlled.

Referring still to FIGS. 1-3, the LMRP 110 includes a riser flex joint 111, a riser adapter 112, an annular BOP 113 and a pair of redundant control units or pods 114. A flow bore 115 extends through the LMRP 110 from the riser 14 at the upper end of the LMRP 110 to the connection 50 at the lower end of the LMRP 110. The riser adapter 112 extends upward from the flex joint 111 and is coupled to the lower end of the riser 14. The flex joint 111 allows the riser adapter 112 and the riser 14 connected thereto to deflect angularly relative to the LMRP 110 while wellbore fluids flow from the wellbore 11 through the BOP stack assembly 100 into the riser 14. The annular BOP 113 comprises an annular elastomeric sealing element that is mechanically squeezed radially inward to seal on a tubular extending through the LMRP 110 (e.g., the string 16, casing, drillpipe, drill collar, etc.) or seal off the flow bore 115. Thus, the annular BOP 113 has the ability to seal on a variety of pipe sizes and/or profiles, as well as perform a complete shut-off ("CSO") to seal the flow bore 115 when no tubular is extending therethrough.

In this embodiment, the BOP stack 120 comprises an annular BOP 113 as previously described, choke/kill valves 131 and choke/kill lines 132. The choke/kill line connections 130 connect the female choke/kill connectors of the LMRP 110 with the male choke/kill adapters of the BOP stack 120, thereby placing the choke/kill connectors of the LMRP 110 in fluid communication with the choke lines 132 of the BOP stack 120. A main bore 125 extends through the BOP stack 120. In addition, the BOP stack 120 includes a plurality of axially stacked ram BOPs 121. Each ram BOP 121 includes a pair of opposed rams and a pair of actuators 126 that actuate and drive the matching rams. In the illustrated embodiment, the BOP stack 120 includes four ram BOPs 121—an upper ram BOP 121 including opposed blind shear rams or blades 121*a* for severing the tubular string 16 and sealing off the wellbore 11 from the riser 14, and the three lower ram BOPs 121 including the opposed pipe rams 121*c* for engaging the string 16 and sealing the annulus around the tubular string 16. In other embodiments, the BOP stack 120 may include a different number of rams, different types of rams, one or more annular BOPs or combinations thereof. As will be described in more detail below, the control pods 114 operate the valves 131, the ram BOPs 121 and the annular BOPs 113 of the LMRP 110 and the BOP stack 120.

The opposed rams 121*a, c* are located in cavities that intersect the main bore 125 and support the rams 121*a, c* as they move into and out of the main bore 125. Each set of rams 121*a, c* is actuated and transitioned between an open position and a closed position by matching actuators 126. In particular, each actuator 126 hydraulically moves a piston within a cylinder to move a connecting rod coupled to one ram 121*a, c*. In the open positions, the rams 121*a, c* are radially withdrawn from the main bore 125. However, in the closed positions, the rams 121*a, c* are radially advanced into the main bore 125 to close off and seal the main bore 125 and/or the annulus around the tubular string 16. The main bore 125 is substantially coaxially aligned with the flow bore 115 of the LMRP 110, and is in fluid communication with the flow bore 115 when the rams 121*a, c* are open.

As shown in FIG. 3, the BOP stack 120 also includes a set or bank 127 of hydraulic accumulators 127*a* mounted on the BOP stack 120. While the primary hydraulic pressure supply is provided by the hydraulic conduits 15 extending along the riser 14, the accumulator bank 127 may be used to support operation of the rams 121*a, c* (i.e., supply hydraulic pressure to the actuators 126 that drive the rams 121*a, c* of the stack 120), the choke/kill valves 131, the connector 50*b* of the BOP stack 120 and the choke/kill connectors 130 of the BOP stack 120. As will be explained in more detail below, the accumulator bank 127 may serve as a backup means to provide hydraulic power to operate the rams 121*a, c*, the valves 131, the connector 50*b*, and the connectors 130 of the BOP stack 120.

Although the control pods 114 may be used to operate the BOPs 121 and the choke/kill valves 131 of the BOP stack 120 in this embodiment, in other embodiments, the BOPs 121 and the choke/kill valves 131 may also be operated by one or more subsea remotely operated vehicles ("ROVs").

As previously described, in this embodiment, the BOP stack 120 includes one annular BOP 113 and four sets of rams (one set of shear rams 121*a*, and three sets of pipe rams 121*c*). However, in other embodiments, the BOP stack 120 may include different numbers of rams, different types of rams, different numbers of annular BOPs (e.g., annular BOP 113) or combinations thereof. Further, although the LMRP 110 is shown and described as including one annular BOP 113, in other embodiments, the LMRP (e.g., LMRP 110) may include a different number of annular BOPs (e.g., two sets of annular BOPs 113). Further, although the BOP stack 120 may be referred to as a "stack" because it contains a plurality of ram BOPs 121 in this embodiment, in other embodiments, BOP 120 may include only one ram BOP 121.

Both the LMRP 110 and the BOP stack 120 comprise re-entry and alignment systems 140 that allow the LMRP 110-BOP stack 120 connections to be made subsea with all the auxiliary connections (i.e., control units, choke/kill lines) aligned. The choke/kill line connectors 130 interconnect the choke/kill lines 132 and the choke/kill valves 131 on the BOP stack 120 to the choke/kill lines 133 on the riser adapter 112. Thus, in this embodiment, the choke/kill valves 131 of the BOP stack 120 are in fluid communication with the choke/kill lines 133 on the riser adapter 112 via the connectors 130. However, the alignment systems 140 are not always necessary and need not be included.

As shown in FIGS. 3-6, the subsea BOP stack assembly 100 further includes a measurement system 200, which includes at least one container. It should be appreciated by those of skill in the art that the containers may be any type of container with an internal volume and an element movable within the internal volume (e.g., piston or bellows type accumulators). In the embodiments illustrated in FIGS. 3-6, the containers are hydraulic accumulators 127*a* that include an element 401 movable within their internal volume, or cavity, 402. The hydraulic accumulator 127*a* body is composed of an outer layer and an inner layer. The outer layer 409 of the accumulators 127*a* may include a metal, metal alloy and/or composite material (e.g., carbon fiber reinforced plastic). Composite materials are lighter than steel counterparts and possess high strength and stiffness, providing high performance in deep water, high pressure applications. The inner layer 410 of the accumulators 127*a* may include a metal and/or metal alloy.

Figure 4:
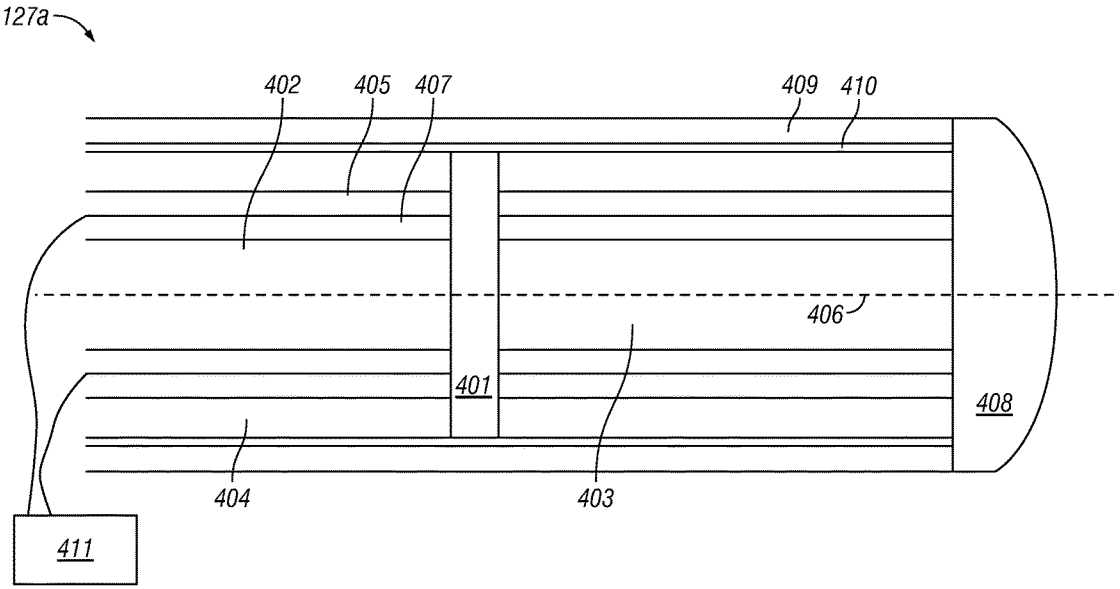
FIG. 4 shows a cross section view of an embodiment of a system for measuring the position of a movable element in a container.

In the embodiment in FIG. 4, the movable element 401 is a piston separating a hydraulic fluid 403 from a gas 404 stored in the internal volumes of the accumulators 127*a*. It should be appreciated by those of ordinary skill in the art that the movable element could be any device movable in an internal volume of a container that is capable of separating fluids. The piston 401 may include a metal, metal alloy, plastic, or rubber. The surface area of the piston 401 includes a conductive surface area, including a conductive material, such as for example a metal (e.g., copper). The conductive surface area of the piston 401 can constitute the entire surface area of the piston, discrete surface areas of the piston, or any portion therebetween.

Referring again to FIG. 4, rubbing strips 405 are disposed along the interior of the accumulator 127*a* in an arrangement parallel to the longitudinal axis 406 of the accumulator 127*a*. In this and other embodiments, the rubbing strips 405 are generally disposed in the interior of the accumulators 127*a* in the direction of the movement of the movable element/piston 401. In one embodiment, the rubbing strips 405 are formed of a non-metallic polymer with a low coefficient of friction (e.g., $\mu_s<1.0$), such as polytetrafluoroethylene. The rubbing strips 405 provide low-friction surfaces, resistant to wear and corrosion, upon which the piston 401 is movable within the accumulator 127*a*.

Figure 6:
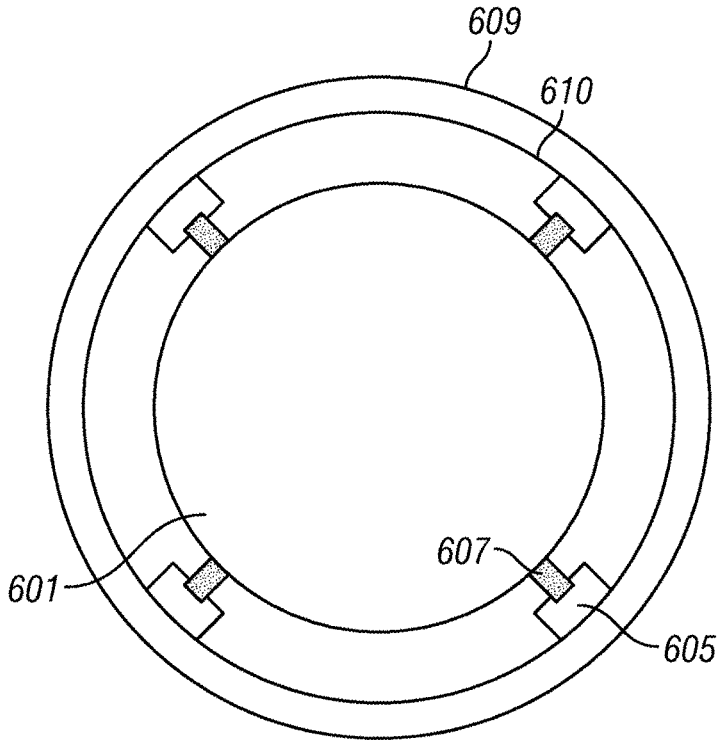
FIG. 6 shows a cross section view of an embodiment of a system for measuring the position of a movable element in the container shown in FIG. 4.

In the embodiment shown in FIG. 4, one conductive strip 407 is disposed along the length of each rubbing strip 405 within the accumulator 127*a*. As illustrated in FIG. 6, the conductive strips 407 are embedded in or otherwise attached to the rubbing strips 405. Each conductive strip 407 extends beyond the profile of its associated rubbing strip 405, so as to be capable of coming into contact with the conductive surface area(s) of the piston 401 as the piston 401 travels within the accumulator 127*a*. In another embodiment, the conductive strips 407 can be placed on top of the rubbing strips 405 rather than being embedded in the rubbing strips 405.

One end of each conductive strip 407 terminates, for example, at an end cap 408 of the accumulator 127*a*. The end cap 408 includes typical openings and porting for communicating fluids (e.g., gas and/or liquid) to the accumulator 127*a* which do not constitute part of the invention and are therefore not shown or described in detail. The other end of each conductive strip 407 is connected to a power source 411. The conductive strip 407 connects to the voltage/current source through a connector, such as a bulkhead connector, not shown. When the conductive surface area of the piston 401 is in contact with the conductive strips 407, a circuit is formed with electrical characteristics (e.g., voltage, current, resistance) that vary as the piston moves along the length of the accumulator 127*a*.

The length of the circuit formed between the piston 401 and conductive strips 407 decreases as the piston 401 moves through the interior of the accumulator 127*a* toward the power source 411. Where one or more electrical characteristics are held constant, the other electrical characteristics of the circuit will vary as the length of the circuit varies. For instance, in general, where the voltage applied to the circuit is held constant, the current will increase and the resistance across the circuit will decrease as the length of the circuit decreases. Precise relationships between electrical characteristics will depend on a variety of factors, including the arrangement of the circuit and the materials of construction.

The location of the piston 401 can be determined based on measuring changes in the electrical characteristics because the electrical characteristics vary as the piston 401 moves along the length of the accumulator 127*a*. Electrical characteristics may be measured from the circuit by any device commonly understood in the art to measure such characteristics, such as a current and/or voltage sensor.

Figure 5:
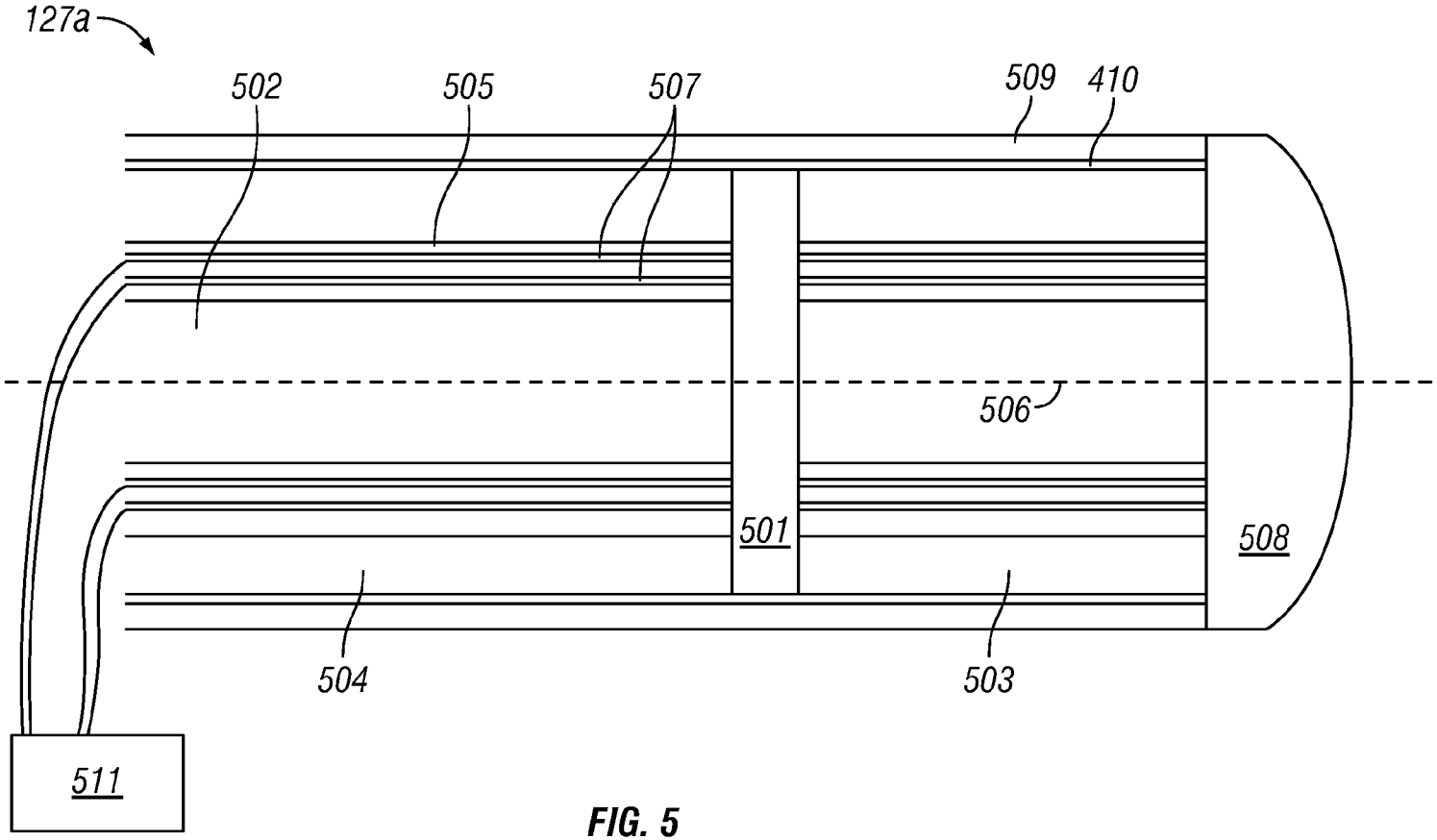
FIG. 5 shows a cross section view of another embodiment of a system for measuring the position of a movable element in a container.

Referring now to FIG. 5, the rubbing strips 505 are disposed along the interior of the accumulator 127*a* in an arrangement parallel to the longitudinal axis of the accumulator 127*a*, similar to the arrangement in FIG. 4. In this embodiment, the rubbing strips 505 are formed of a non-metallic polymer with a low coefficient of friction (e.g., $\mu_s<1.0$), such as polytetrafluoroethylene. The rubbing strips 505 provide low-friction surfaces, resistant to wear and corrosion, upon which the piston 501 is movable within the accumulator 127*a*.

In the embodiment shown in FIG. 5, pairs of conductive strips 507 are disposed along the length of each rubbing strip 505 within the accumulator 127*a*. The pairs of conductive strips 507 are embedded in the rubbing strips 505. The pairs of conductive strips 507 extend beyond the profile of the rubbing strips 505, so as to be capable of coming into contact with the conductive surface area(s) of the piston 501 as it travels within the accumulator 127*a*. In another embodiment, pairs of conductive strips 507 can be placed on top of the rubbing strips 505 rather than being embedded in the rubbing strips 505. Disposing pairs of conductive strips 507 in each rubbing strip 505 provides for a circuit between the conductive surface area of the piston 501 and the pair of conductive strips 507 in/on each rubbing strip 505. This arrangement provides for redundancy (e.g., multiple circuits generating electrical characteristics which can be monitored to determine piston location) and enhances the accuracy of the measurement system by allowing for comparison of electrical characteristics of numerous circuits. It should also be appreciated that a pair of conductive strips 507 may also be disposed along or embedded within one rubbing strip 505.

One end of each conductive strip 507 may terminate at an end cap 508 of the accumulator 127*a*. The end cap 508 includes typical openings and porting for communicating fluids (e.g., gas and/or liquid) to the accumulator 127*a* which do not constitute part of the invention and are therefore not shown or described in detail. The other end of each conductive strip 507 is connected to a voltage/current source 511. The conductive strip 507 connects to the voltage/current source through a connector, such as a bulkhead connector, which does not constitute part of the invention and is therefore not shown or described in detail. When the conductive surface area of the piston 501 is in contract with the conductive strips 507, a circuit is formed which possesses electrical characteristics (e.g., voltage, current, resistance) that vary as the piston moves along the length of the accumulator 127*a*. As discussed above, the location of the piston 501 can be determined based on the electrical characteristics readings from the circuit because the electrical characteristics vary as the piston 501 moves along the length of the accumulator 127*a*. Electrical characteristic readings may be taken from the circuit by any device commonly understood in the art to detect such readings, such as a current and/or voltage sensor.

Although the present invention has been described with respect to specific details, it is not intended that such details should be regarded as limitations on the scope of the invention, except to the extent that they are included in the accompanying claims.

What is claimed is:

1. A measurement system, comprising:

an accumulator including an element movable within an internal volume of the accumulator, wherein the movable element surface area includes conductive material;

two conductive strips disposed along the length of the interior of the accumulator in the direction of movement of the element, each offset from an axis of the accumulator, each conductive strip capable of contacting the conductive material of the movable element surface area; and a sensor to measure an electrical characteristic of the circuit determined by the position of the element within the accumulator.

2. The measurement system of claim 1, wherein the electrical characteristic includes at least one of voltage, current, and resistance.

3. The measurement system of claim 1, further comprising:

two rubbing strips disposed along the length of the interior of the accumulator; and wherein at least one conductive strip is disposed along a rubbing strip.

4. The measurement system of claim 3, wherein the rubbing strips include a non-metallic material.

5. The measurement system of claim 3, wherein the two conductive strips are disposed along the length of each of the at least two rubbing strips.

6. The measurement system of claim 1, wherein the movable element includes a piston movable within an internal volume of the accumulator.

7. The measurement system of claim 1, wherein the accumulator is a hydraulic fluid accumulator.

8. The measurement system of claim 7, wherein the hydraulic fluid accumulator is capable of providing hydraulic fluid to operate a blowout preventer.

9. The measurement system of claim 1, wherein the accumulator comprises an outer layer and an inner layer.

10. The measurement system of claim 9, wherein the outer layer includes at least one of a metal, metal alloy, and composite material.

11. A measurement system for measuring the fluid volume in a subsea hydraulic accumulator capable of providing hydraulic fluid to power a blowout preventer, including:

an element movable within an internal volume of the accumulator, wherein the movable element surface area is at least partially composed of conductive material;

rubbing strips disposed along the interior of the accumulator, the movable element movable along the rubbing strips;

conductive strips disposed along the length of at least one rubbing strip, the conductive strips capable of contacting the movable element; and a sensor to measure an electrical characteristic of the circuit determined by the position of the movable element within the accumulator.

12. The measurement system of claim 11, wherein the electrical characteristic includes at least one of voltage, current, and resistance.

13. The measurement system of claim 11, wherein each conductive strip is disposed along one of the rubbing strips.

14. The measurement system of claim 11, wherein the movable element includes a piston movable within an internal volume of the accumulator.

15. The measurement system of claim 11, wherein the accumulator is a hydraulic fluid accumulator.

16. The measurement system of claim 11, wherein the accumulator includes an outer layer including at least one of metal, metal alloy, and composite material.

17. The measurement system of claim 11, wherein the rubbing strips include a non-metallic material.

18. The measurement system of claim 11, wherein two conductive strips are disposed along the length of each of the two or more rubbing strips.

* * * * *